US006010812A

United States Patent [19]

Barbetta et al.

[11] Patent Number: 6,010,812

[45] **Date of Patent: *Jan. 4, 2000**

[54] COATED CARRIER

[75] Inventors: Angelo J. Barbetta, Penfield; Robert D. Bayley, Fairport; Thomas R. Hoffend, Webster; Scott M. Silence, Fairport; K. Derek Henderson, Rochester; Carol A. Fox, Canandaigua; John G. VanDusen, Walworth, all of N.Y.

[73] Assignee: Xerox Corporation, Stamford, Conn.

[ * ] Notice: This patent is subject to a terminal disclaimer.

[21] Appl. No.: 09/140,439

[22] Filed: Aug. 26, 1998

[51] Int. Cl.[7] ..... G03G 9/13

[52] U.S. Cl. ..... 430/106.6; 430/97; 430/108

[58] Field of Search ..... 430/108, 106.6, 430/97

[56] References Cited

U.S. PATENT DOCUMENTS

| | | | |
|---|---|---|---|
| 3,533,835 | 10/1970 | Hagenbach et al. | 117/217 |
| 3,590,000 | 6/1971 | Palermiti et al. | 252/62.1 |
| 3,658,500 | 4/1972 | Hagenbach | 65/21 |
| 3,798,167 | 3/1974 | Kukla et al. | 252/62.1 |
| 3,918,968 | 11/1975 | Kukla et al. | 63/1.5 D |
| 3,922,382 | 11/1975 | Kukla et al. | 427/58 |
| 3,939,086 | 2/1976 | Hagenbach | 252/62.1 P |
| 4,020,192 | 4/1977 | Nozaki | 430/108 |
| 4,233,387 | 11/1980 | Mammino et al. | 430/137 |
| 4,238,558 | 12/1980 | Ziolo | 430/108 |
| 4,264,697 | 4/1981 | Perez et al. | 430/107 |
| 4,298,672 | 11/1981 | Lu | 430/108 |
| 4,310,611 | 1/1982 | Miskinis | 430/107 |
| 4,338,390 | 7/1982 | Lu | 430/106 |
| 4,397,935 | 8/1983 | Ciccarelli et al. | 430/110 |
| 4,434,220 | 2/1984 | Abbott et al. | 430/108 |
| 4,560,635 | 12/1985 | Hoffend et al. | 430/106.6 |
| 4,810,611 | 3/1989 | Ziolo et al. | 430/106.6 |
| 4,935,326 | 6/1990 | Creatura et al. | 430/108 |
| 4,937,166 | 6/1990 | Creatura et al. | 430/108 |
| 5,376,494 | 12/1994 | Mahabadi et al. | 430/137 |
| 5,744,275 | 4/1998 | Duggan et al. | 430/108 |

FOREIGN PATENT DOCUMENTS

| | | |
|---|---|---|
| 63-226661 | 9/1988 | Japan . |
| 10-73968 | 3/1998 | Japan . |
| 10-161356 | 6/1998 | Japan . |

OTHER PUBLICATIONS

Chemical Abstracts 129:128945, Jun. 1998.
Chemical Abstracts 128:302077, Mar. 1998.
Chemical Abstracts 110:222557, Sep. 1988.

*Primary Examiner*—Christopher D. Rodee
*Attorney, Agent, or Firm*—E. O. Palazzo

[57] ABSTRACT

A carrier comprised of a core and a polymer coating of (1) styrene/monoalkylaminoalkyl methacrylate or (2) styrene/dialkylaminoalkyl methacrylate.

32 Claims, No Drawings

COATED CARRIER

PENDING APPLICATIONS AND PATENTS

Illustrated in U.S. Pat. No. 5,945,244; U.S. Ser. No. (09/140,524; U.S. Ser. No. 09,140,594; and U.S. Pat. No. 5,935,750; all filed concurrently herewith, and the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in U.S. Pat. No. 5,945,244 a carrier comprised of a core, and thereover a polymer of styrene, an olefin and a dialkylaminoalkyl methacrylate; in copending application U.S. Ser. No. 09,140,524 a carrier composition comprised of a core and thereover a polymer (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; in copending application U.S. Ser. No. 09/140,594 a carrier comprised of a core and thereover a polymer or polymers of (1) methylmethacrylate and a monoalkyl aminoalkyl methacrylate, or (2) a polymer or polymers of methylmethacrylate and dialkylaminoalkyl methacrylate; and in U.S. Pat. No. 5,935,750 a carrier comprised of a core and a polymer coating containing a quaternary ammonium salt functionality.

The appropriate components and processes of the above cited copending applications may be selected for the present invention in embodiments thereof.

BACKGROUND OF THE INVENTION

This invention is generally directed to developer compositions, and more specifically, the present invention relates to developer compositions with coated carrier components, or coated carrier particles that can be prepared by, for example, dry powder processes. More specifically, the present invention relates to carrier compositions comprised of a core and thereover copolymers of styrene and a monoalkylaminoalkyl methacrylate, or styrene and a dialkylaminoalkyl methacrylate.

More specifically, the present invention relates to carrier particles comprised of a core with a coating thereover of copolymers of styrene and diisopropylaminoethyl methacrylate, styrene copolymers with monoalkyl or dialkyl aminoethyl methacrylate, t-butylaminoethyl methacrylate, and the like. The carrier may include the copolymer coating thereover in admixture with other suitable polymers, and more specifically, with a second polymer, such as a fluoropolymer, polymethylmethacrylate, poly(urethane), especially a crosslinked polyurethane, such as a poly (urethane)polyester and the like, and moreover the copolymer, or mixture of polymer coatings may contain a conductive component, such as carbon black, and which conductive component is preferably dispersed in the copolymer coating. With the conductive component, there are enabled carriers with increased developer triboelectric response, that is, stable triboelectric values up to about 80 microcoulombs per gram at relative humidities of from about 20 to about 90 percent, improved image quality performance, excellent high conductivity ranges of, for example, from about $10^{-10}$ to about $10^{-7}$ $(\text{ohm-cm})^{-1}$, and the like. The carrier triboelectrical charge may be, for example, a carrier tribo range of from about a plus (positive charge) 25 to about 80, and preferably from about a positive 35 to about a positive 70 microcoulombs per gram as determined by the known Faraday Cage method.

The carrier particles of the present invention can be selected for a number of different xerographic copiers and printers, such as high speed color xerographic copies, in the range of, for example, about 70 to about 135 impressions per minute, printers, digital copiers, and more specifically, wherein colored copies with excellent and substantially no background deposits are achievable in copiers, printers, digital copiers, and the combination of xerographic copiers and digital systems. Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected depending on the polymer composition and dispersant component applied to the carrier core and the type and amount of the conductive component selected.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith.

Carrier particles for use in the development of electrostatic latent images are described in many patents including, for example, U.S. Pat. No. 3,590,000. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where part of, or the entire coating may separate from the carrier core in the form of chips or flakes, and fail upon impact, or abrasive contact with machine parts and other carrier particles. These flakes or chips, which cannot generally be reclaimed from the developer mixture, usually adversely affect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low tribo as compared to the high tribo carriers of the present invention.

There are illustrated in U.S. Pat. No. 4,233,387, the disclosure of which is totally incorporated herein by reference, coated carrier components for electrostatographic developer mixtures comprised of finely divided toner particles clinging to the surface of the carrier particles.

Specifically, there is disclosed in this patent coated carrier particles obtained by mixing carrier core particles of an average diameter of from between about 30 microns to about 1,000 microns with from about 0.05 percent to about 5.0 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There is illustrated in U.S. Pat Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof. The present invention has the advantage overthis prior art of for example achieving high triboelectric, especially positive charge on the carrier particles, that is, high negative triboelectric charge is imparted to the toner particles developed onto a photoreceptor in, for example, a xerographic development environment. Further, a full range of electrical properties of the carrier particles can be achieved at high triboelectric charging values, from carrier conductivities of $10^{-17}$ mho/cm to $10^{-6}$ mho/cm, that is, from the insulative to the conductive regime.

With further reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof; and therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves processing excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome these disadvantages, and further enable developers that are capable of generating high triboelectric charging values with finely divided toner particles; and also wherein the carrier particles in embodiments are of substantially constant conductivity.

When resin coated carrier particles are prepared by powder coating process the majority of the coating materials are fused to the carrier surface thereby reducing the number of toner impaction sites on the carrier material. Additionally, there can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities of from about $10^{-6}$ (ohm-cm)$^{-1}$ to about $10^{-17}$ (ohm-cm)$^{-1}$, preferably from about $10^{-10}$(ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$, determined in a magnetic brush conducting cell, and high carrier triboelectric charging value of from a positive triboelectric charge of positive about 20 to a positive of about 80, and for example, from a positive about 30 to a positive about 80, microcoulombs per gram on the carrier particles as determined by the known Faraday Cage technique. Thus, the developers of the present invention can be formulated with conductivity values in a certain range with different triboelectric charging characteristics by, for example, maintaining the same total coating weight on the carrier particles and contained therein conductive particles of, for example, carbon black.

Other U.S. Patents that may be of interest include U.S. Pat. No. 3,939,086, which illustrates steel carrier beads with polyethylene coatings, see column 6; U.S. Pat. No. 5 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is a feature of the present invention to provide toner and developer compositions with carrier particles containing polymer coatings.

In another feature of the present invention there are provided dry coating processes for generating carrier particles of substantially constant conductivity parameters.

In yet another feature of the present invention there are provided dry coating processes for generating carrier particles of substantially constant conductivity parameters, and excellent triboelectric charging values.

Further, in yet another feature of the present invention there are provided carrier particles with tribo values of at least about 30 microcoulombs per gram, and wherein the carrier includes thereover a copolymer coating of a copolymer of polystyrene/monoalkyl or dialkylaminoethylmethacrylate, and poly(urethane), and a second polymer.

Aspects of the invention include a carrier comprised of a core and a polymer coating of (1) styrene/monoalkylaminoalkyl methacrylate or (2) styrene/dialkylaminoalkyl methacrylate; a carrier wherein each of said alkyls contain from 1 to about 25 carbon atoms; a carrier wherein each of said alkyls contain from 1 to about 6 carbon atoms; a carrier wherein said polymer is a copolymer of styrene, and dimethylaminoethyl methacrylate, a copolymer of styrene and diethylaminoethyl methacrylate, a copolymer of styrene and t-butylaminoethyl methacrylate, or a copolymer of styrene and diisopropylaminoethyl methacrylate; a carrier wherein the polymer is (1) a copolymer of t-butyl styrene, and dimethylaminoethyl methacrylate, (2) a copolymer of t-butyl styrene and diethylaminoethyl methacrylate, a copolymer of t-butyl styrene and t-butylaminoethyl methacrylate, or a copolymer of t-butyl styrene and diisopropylaminoethyl methacrylate; a carrier wherein said polymer is selected from the group consisting of (1) polystyrene/monoalkyl or dialkylaminoalkyl methacrylate, and (2) poly t-butyl styrene/monoalkyl or poly t-butyl dialkylaminoalkyl methacrylate; a carrier wherein polymer (1) contains from about 50 to about 95 weight percent of styrene, and from about 5 to about 50 weight percent of said monoalkyl or dialkylaminoalkyl methacrylate, and wherein polymer (2) contains t-butyl of styrene in an amount of from about 50 to about 95; a carrier wherein polymer (1) possesses an $M_w$ of from about 20,000 to about 800,000, and an $M_n$ of from about 12,000 to about 350,000, and polymer (2) possesses an $M_w$ of from about 20,000 to about 800,000, and of an $M_n$ of from about 12,000 to about 350,000 as measured by gel permeation chromatography; a carrier wherein the polymer coating weight is from about 0.1 to about 20 weight percent; a carrier wherein the polymer coating weight is from about 1 to about 3 weight percent; a carrier wherein the polymer coating contains a conductive component; a carrier wherein the conductive component is a metal oxide, or is carbon black; a carrier wherein said conductive component is carbon black selected in an amount of from about 10 to about 60 weight percent; a carrier wherein said core is a metal, a metal oxide, or a ferrite; a carrier with a triboelectric charge of from about a positive 30 to about a positive 80 microcoulombs per gram; a carrier with a triboelectric charge of from about a positive 35 to about a positive 50 microcoulombs per gram; a developer comprised of the carrier and toner; a developer wherein the toner is comprised of a thermoplastic resin and colorant; a developer wherein the colorant is a pigment or a dye; a developer comprised of a (1) carrier core and coating of a polymer of styrene/monoalkylaminoalkyl methacrylate or styrene/dialkylaminoalkyl methacrylate, and (2) a toner; a developer wherein the carrier core is selected from the group consisting of iron, ferrites, steel and nickel; a carrier wherein said dialkylaminoalkyl methacrylate is diisopropylaminoethyl methacrylate; a carrier with a carrier triboelectric charge of from about a positive 30 to about a positive 80 microcoulombs per gram, and a toner triboelectric charge of from about a negative 30 to about a negative 80 microcoulombs per gram, or with a carrier triboelectric charge of from about a positive 35 to about a positive 50 microcoulombs per gram and a toner triboelectric charge of from about a negative 35 to about a negative 50 microcoulombs per gram; a carrier with a volume average diameter of from about 50 to about 200 microns; a carrier containing a second polymer coating; a carrier wherein said polymer coating is poly (styrene/diisopropylaminoethyl methacrylate) with a diisopropylaminoethyl methacrylate content of from about 27 weight percent to about 40 weight percent, the coating weight of polymer on said core is from about 0.3 to about 1.0 percent, the carrier volume median diameter is from about 65 to about 120 microns, and the core is steel or a ferrite; a carrier wherein said core is a metal of spherical or atomized steel, a metal oxide, or magnetite, Cu/Zn-ferrite, Ni/Zn-ferrite, Sr (strontium)-ferrite, or Ba-ferrite; a carrier comprised of a core and a polymer of styrene/alkylaminoalkyl methacrylate, styrene/dialkylaminoalkyl methacrylate, or mixtures thereof; a carrier wherein said alkyl contains from 1 to about 12 carbon atoms; a process wherein an image is developed with the composition; a carrier wherein said polymer comprises a mixture of polymers; and the carrier particles selected can be prepared by mixing low density porous magnetic, or magnetically attractable metal core carrier particles with from, for example, between about 0.05 percent and about 5 percent by weight, based on the weight of the coated carrier particles, of the polymer, and which polymer may optionally contain dispersed therein carbon black or a similar conductive component until adherence thereof of the polymer to the carrier core by mechanical impaction or electrostatic attraction; heating the resulting mixture of carrier core particles and polymer to a temperature, for example, of between from about 200° F. to about 625° F., preferably about 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter; a carrier composition comprised of a core, and thereover a polymer as indicated herein, such as a styrene dialkylaminoalkyl methacrylate present in an amount of, for example, from about 0.05 to about 5 weight percent of the total carrier composition, and which coating may optionally contain a conductive component, such as a metal oxide, a conductive component like carbon black, and wherein the conductive component is selected in an amount of from about 10 to about 75 weight percent, and preferably from about 15 to about 50 weight percent; a carrier with two polymers thereover, wherein the first polymer is as indicated herein, and wherein the conductive component for the first or second polymer is a metal oxide, or a pigment like carbon black selected in an amount of from about 10 to about 50 weight percent; and wherein the second polymer is as illustrated herein in the U.S. patents incorporated herein by reference, for example a fluorocarbon, polymethylmethacrylate (PMMA), a thermosetting polymer such as a thermosetting polyurethane, a polyester, or a styrene polymer, and wherein the first polymer is selected in an amount of from about 1 to about 100, or from about 10 to about 75 weight percent, based on the total weight of the polymers and conductive components present in the carrier and the second polymer is selected in an amount of from about 99 to about 0, or from about 90 to about 25 weight percent, based on the total weights of all polymers and conductive components present in the carrier; or wherein the carrier core is a metal, a ferrite, a metal oxide, and the like, such as known carrier cores.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics; and also, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide and available from D.M. Steward Corporation or Powdertech Corporation, Ni/Zn-ferrite available from Powdertech Corporation, Sr (strontium)-ferrite, containing, for example, about 14 percent strontium oxide and 86 percent iron oxide and available from Powdertech Corporation and Ba-ferrite, magnetites, available, for example, from Hoeganaes Corporation (Sweden), nickel, mixtures thereof, and the like. Preferred carrier cores include ferrites, and sponge iron, or steel grit with an average particle size diameter of from between about 30 microns to about 200 microns.

Examples of polymer coatings selected for the carrier include copolymers of styrene and a monoalkyl, or dialkyl amino alkyl methacrylate such as a dimethylaminoethyl methacrylate, diethylaminoethyl methacrylate, diisopropylaminoethyl methacrylate, or t-butylaminoethyl methacrylate. Specific examples of copolymer coatings are poly (styrene/dimethyl aminoethylmethacrylate), poly(styrene/tertiary-butylaminoethyl methacrylate), poly(styrene/diethylaminoethylmethacrylate), poly(styrene/diisopropylamino ethylmethacrylate), copolymers of styrene with other monoalkyl or dialkylaminoethyl methacrylates Akyl contains, for example, from about 1 to about 25, and preferably from 1 to about 10 carbon atoms, such as methyl, ethyl, propyl, butyl, pentyl, heptyl, hexyl, and the like.

The monomers for synthesizing the above polymers are obtained from Aldrich Chemical Company with regard to styrene, dimethylaminoethyl methacrylate, and diethylaminoethyl methacrylate, and Scientific Polymer Products with regard to diisopropylaminoethyl methacrylate and t-butylaminoethyl methacrylate. Synthetic methods for the preparation of polymers and copolymers from these monomers may be bulk polymerization, solution polymerization, emulsion polymerization, suspension or semisuspension polymerization, or any other known suitable polymerization methods.

The polymers can also be prepared by bulk polymerization which can be accomplished with monomers in the absence of solvent, and by solution polymerization can be effected in a solvent medium such as toluene in which the monomer or mixture of monomers is combined with a suitable initiator such as 2,2'-azobis(2-methylpropionitrile), referred to as AIBN, and reacted for an effective period of time, for example from about 7 to about 15, and preferably about 11 hours, at an elevated temperature, for example from about 65° C. to about 80° C. From this reaction, a solution with a solids content of about 25 to 30 percent by weight polymer can be obtained, in which the polymer has a glass transition of about 60° C. to about 130° C. and molecular weight by gel permeation chromatography of about $M_w$=50,000 to about 700,000 with molecular weight dispersibility, that is the ratio of $M_w/M_n$, or MWD=about 1.6 to about 3.0.

The suspension polymerization method involves mixing monomers and initiator to obtain a clear organic phase. The monomer mixtures can contain, for example, from about 50 to about 98 weight percent of styrene or t-butyl styrene or other derivatives of styrene, and from about 2 to about 50 weight percent of said monoalkyl or dialkylaminoalkyl methacrylate, and more preferably from 2 to 30 weight percent of said monoalkyl or dialkylaminoalkyl methacrylate. A suitable polymerization initiator, such as 2,2'-azobis (2-methylpropionitrile), referred to as AIBN, is used from about 0.1 to 2.0 weight percent based on monomer, and more preferably from 0.2 to 1.0 weight percent. The organic phase is then combined with an aqueous solution containing about 0.5 to about 5.0 weight percent of an appropriate monomer suspending agent like polyvinylalcohol, such as Air Products Airvol 603 polyvinyl alcohol, and more preferably from 1.5 to 3.0 weight percent of polyvinyl alcohol and an aqueous phase inhibitor such as potassium iodide of from about 1.5 to about 5.0 weight percent on monomer. The desired particle size is obtained by homogenizing the two phases with a Brinkmen homogenizer equipped with a Polytron Generator with three stationary and three moving rings of flat rotor design for five minutes at about 4,000 to 14,000 RPM and more preferably from 6,000 to 10,000 RPM. The resulting suspended organic phase is then transferred to the preheated reactor and stirred at about 65 to 100 RPM to maintain stability of the suspension. The suspension is then held at about 70° C. for about 4 to 8 hours to complete the polymerization. The polymer suspension is then cooled, removed from the reactor, washed and centrifuged 5 times with a 90/10 volume ratio of methanol/water and finally washed with water only. The wet polymer suspension is then air dried, placed in a vacuum oven at from about 40.0° C. to about 80.0° C. to complete drying, and further broken down to its primary particle size by ball milling followed by screen sieving. This process yields a polymer particle size having a volume median of about 1.50 20 $\mu$m to about 10.0 $\mu$m, and a molecular weight by gel permeation chromatography ranging from, for example, about 100,000 to about 700,000.

Emulsion polymerization is accomplished by the continuous addition to a suitable reaction vessel containing water, and providing mechanical stirring, nitrogen atmosphere, and thermostatic control, a mixture of monomers and an initiator, such as ammonium persulfate initiator, as obtained from the Aldrich Chemical Company, (0.2 to 0.6 percent by weight of monomers). The polymerization can be effected by heating to, for example, between about 55° C. and about 65° C. to achieve molecular weights, $M_w$ by gel permeation chromatography ranging from, for example, about 200,000 to about 500,000. The polymer or copolymer powder is isolated by, for example, freeze drying in vacuo. The resulting polymer particle diameter size is, for example, 0.1 to 2.0 microns in volume average diameter.

The polymer coating preferably has dispersed therein in embodiments conductive components, such as metal oxides like tin oxide, conductive carbon blacks, and the like, in effective amounts of, for example, from about 0 to about 70 and preferably from about 15 to about 60 weight percent. Specific examples of conductive components include the conductive carbon black SC Ultra available from Conductex, Inc., and antimony-doped tin oxide Zelec ECP3005-XC manufactured by E.I. DuPont.

The process for incorporating the polymer onto a carrier core can be sequential, a process in which one of the two polymers, when two polymers are selected, is fused to the surface in a first step and the second polymer is fused to the surface in a subsequent fusing operation. Alternatively, the process for incorporation can comprise a single fusing.

Also, the carrier coating can have incorporated therein various known charge enhancing additives, such as quaternary ammonium salts, and more specifically, distearyl dimethyl ammonium methyl sulfate (DDAMS), bis[1 -[(3,5-disubstituted-2-hydroxyphenyl)azo]-3-(mono-substituted)-2-naphthalenolato(2–)] chromate(1–), ammonium sodium and hydrogen (TRH), cetyl pyridinium chloride (CPC), FANAL PINK® D4830, and the like, including those as specifically illustrated herein, and other effective known charge agents or additives, such as E84 zinc complex of 3,5-ditertiary butyl salicylic acid and E-88 tris(3,5-ditertiary butyl sallicylato) aluminum, which are commercially available from Orient Chemical Company, TRH ammonium bis[1-(3,5-dinitro-2-hydroxy phenyl) azo-3-(N-phenylcarbamoyl)-2-naphthalenolate] chromate, which is commercially available from Hodogaya Chemicals, and aluminum complexes such as those disclosed in U.S. Pat. No. 324,613 and hydroxy bis(3,5-di-tertiary butyl salicylic) aluminate monohydrate disclosed in U.S. Pat. No. 5,223,368 the disclosures of which are totally incorporated herein by reference. The charge additives are selected in various effective amounts, such as from about 0.05 to about 15, and from about 0.1 to about 3 weight percent, based on the sum of the weights of all polymer, conductive additive. The addition of various known charge enhancing additives can act to further increase the positive triboelectric charge imparted to the carrier, and therefore, further increase the negative triboelectric charge imparted to the toner in, for example, a xerographic development subsystem.

Examples of second polymers selected can include polymonoalkyl or dialkyl methacrylates or acrylates, polyurethanes, fluorocarbon polymers such as polyvinylidenefluoride, polyvinylfluoride, and polypentafluorostyrene, polyethylene, polyethylene-co-vinylacetate, polyvinylidenefluoride-co-tetrafluoroethylene, and the like. Other known related polymers not specifically mentioned herein may also be selected, such as those illustrated in the U.S. Pat. No. 4,937,166 and U.S. Pat. No. 4,935,326 patents mentioned herein.

Another second polymer is comprised of a thermosetting polymer, more specifically a poly(urethane) thermosetting resin which contains, for example, from about 75 to about 95, and preferably about 80 percent by weight of a polyester polymer, which, when combined with an appropriate crosslinking agent such as isopherone diisocyannate and initiator such as dibutyl tin dilaurate, forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first copolymer polymer, generally prior to mixing with the core, which when fused forms a uniform coating of the first and second polymers on the carrier surface. The second polymer is present in an amount of from about 0 percent to about 99 percent by weight, based on the total weight of the first and second polymers and the conductive component in the first polymer.

Advantages of the carriers of the present invention include, for example, excellent robust carrier tribo charge of a positive value, excellent admix, for example from about 1 to about 30 seconds as determined in the charge spectrograph, and the like.

Other advantages of the present invention include increased resistance of the carrier to mechanical aging in a xerographic environment and a decreased sensitivity of the carrier triboelectric value to the relative humidity of the environment. With respect to high toner tribo charge of a negative value, this property is important to xerographic, especially color applications, primarily because there is enabled development of toner particles into regions of the imaging member, such as a photoreceptor where strong fringe electrical fields exist, that is, at the borders of solids areas and lines. Developing toner particles through these fringe fields minimizes or eliminates the untoned part of the image which appears between two adjacent colors in an image.

Various effective suitable processes can be selected to apply the polymer, or mixture, for example from 2 to about 5, and preferably 2, of polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-7}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders, include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin. Polyester resins obtained from the reaction of propoxylated and ethoxylated bisphenol A diols with dicarboxylic acids/esters, i.e. isophthalic acid and terephthalic acid, which may or may not be branched/crosslinked by multifunctional hydroxyl or carboxylic acid containing branching agents and which may or may not be unsaturated due to reaction with maleic anhydride/fumaric acid structures.

Generally, from about 1 part to about 5 parts by weight of toner particles are mixed with from about 10 to about 300 parts by weight of the carrier particles.

Numerous well known suitable colorants, such as pigments dyes, or mixtures thereof, and preferably pigments can be selected as the colorant for the toner particles including, for example, carbon black, nigrosine dye, lamp black, iron oxides, magnetites, and mixtures thereof. The colorant, which is preferably carbon black, should be present in a sufficient amount to render the toner composition highly colored. Thus, the colorant is present in amounts of for example, from about 1 percent by weight to about 20, and preferably from about to about 12 percent by weight, based on the total weight of the toner components, however, lesser or greater amounts of pigment may be selected. Colorants include dyes, pigments, mixtures thereof, mixtures of dyes, mixtures of pigments, and the like.

When the colorant particles are comprised of magnetites, which are a mixture of iron oxides ($FeO \cdot Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

Also, there may be selected colored toner compositions comprised of toner resin particles, carrier particles and as colorants, such as pigments, dyes, and mixtures thereof, and preferably magenta, cyan and/or yellow particles, and mixtures thereof. More specifically, illustrative examples of magentas that may be selected include 1,9-dimethyl-substituted quinacridone and anthraquinone dye identified in the Color Index as Cl 60720, Cl Dispersed Red 15, a diazo dye identified in the Color Index as Cl 26050, Cl Solvent Red 19, and the like. Examples of cyans that may be used include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy- 4-sulfonanilide phenylazo-4'-chloro-2,5-dimethoxy acetoacetanilide, permanent yellow FGL, and the like. Other known suitable colorants, such as reds, blues, browns, greens, oranges, and the like can be selected. These colorants, especially pigments are generally present in the toner composition in an amount of from about 1 weight percent to about 15, and for example, from about 2 to about 12 weight percent based on the weight of the toner components of binder and pigment.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and for example, from about 3 to about 12 percent by weight. These charge additives can also be dispersed in the carrier polymer coating as indicated herein.

The toner composition of the present invention can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, and the like. Other methods include those well known in the art such as spray drying, melt dispersion, dispersion polymerization and suspensione polymerization. In one dispersion polymerization method, a solvent dispersion of the resin particles and the pigment particles are spray dried under controlled conditions to result in the desired product. Toner particles sizes and shapes are known and include, for example, a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990; 4,585,884; 4,584,253 and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images obtained with this developer composition possess, for example, acceptable solids, excellent halftones, and desirable line resolution with acceptable or substantially no background deposits excellent chroma, superior color intensity, constant color chroma and intensity over extended time periods, such as 1,000,000 imaging cycles, and the like.

The following Examples are being supplied to further define the present invention, it being noted that these Examples are intended to illustrate and not limit the scope of the present invention. Parts and percentages are by weight unless otherwise indicated.

SYNTHETIC EXAMPLE I

A copolymer of 60 weight percent styrene and 40 percent diisopropylaminoethyl methacrylate (DIAEMA) was synthesized by an emulsion copolymerization which involved initiation and growth of copolymer latex particles by the continuous addition of an emulsified monomer mixture, and more specifically, a mixture of 60 weight percent styrene and 40 weight percent diisopropylaminoethyl methacrylate monomers to provide a product with a solids content of from about 15 percent by weight to about 40 percent by weight, which solids content were comprised of the copolymer poly(styrene-co-DIAEMA) at approximately a 60/40 monomer ratio. A process known as "seed and growth" emulsion polymerization was utilized, whereby a solution of 1.0 gram of ammonium persulfate, together with 21 grams of Triton X-405 surfactant, in 1 liter of distilled water was prepared in a suitable reaction vessel, and thereafter there was provided mechanical stirring, a nitrogen atmosphere, and a thermostatic control. Initiation and growth of latex particles was accomplished by the addition of approximately 25 percent of the monomer mixture with the temperature at 50° C. Rapid stirring (170 to 180 RPM) was continued until any exotherm was completed. This was followed by a continuous and metered addition of the remaining monomer mixture at a rate of 1.0 to 2.0 grams/minute. This polymerization stage was accomplished between 55° C. to 56° C., with heating continued for an additional 1 to 3 hours. The copolymer powder was isolated by freeze drying the residue free latex in vacuo. The resulting number median particle diameter of the above copolymer product was 0.10 to 0.50 micron, as determined by light scattering measurement.

Molecular weight ($M_w$) of the product polymer was determined by gel permeation chromatography and was typically in the range of 200,000 to 500,000, and more specifically, a polystyrene equivalent molecular weight of $M_w$=346,000 was achieved.

SYNTHETIC EXAMPLE II

A copolymer of 60 weight percent styrene and 40 percent diisopropylaminoethyl methacrylate (DIAEMA) was synthesized by an emulsion copolymerization which involved initiation and growth of copolymer latex particles by the continuous addition of a monomer mixture, and more specifically, a mixture of 60 weight percent styrene and 40 weight percent diisopropylaminoethyl methacrylate monomers, to which had been introduced 0.22 gram of divinyl benzene, as a branching and crosslinking agent. A product with solids content of from 15 percent by weight to about 30 percent by weight was composed of the copolymer poly(styrene-co-DIAEMA) at approximately a 60/40 monomer ratio. A process known as "seed and growth" emulsion polymerization was utilized, whereby a solution of 1.0 gram of ammonium persulfate with 21 grams of Triton X-405 surfactant in 1 liter of distilled water, was prepared in a suitable reaction vessel with mechanical stirring, a nitrogen atmosphere, and a thermostatic control. Initiation and growth of latex particles was accomplished by the addition of approximately 25 percent of the styrene/DIAEMA monomer mixture, with the temperature at 50° C. Rapid stirring was continued until any exotherm was completed. This was followed by a continuous and metered addition at a rate of 1.0 to 2.0 grams/minute of the remaining monomer mixture, to which had been introduced 0.22 gram of divinyl benzene. This polymerization stage was accomplished at 55.5° C., with heating continued for an additional 3.5 hours.

The copolymer powder was isolated by freeze drying the residue free latex in vacuo. The resulting number median particle diameter of the above copolymer product was 0.10 to 0.50 micron, as determined by light scattering measurement.

Molecular weight ($M_w$) of the isolated polymer was determined by gel permeation chromatography and was typically in the range of 200,000 to 500,000. The specific $M_w$ in this Example could only be estimated, as a turbid solution in THF was observed, which could effect GPC determination.

SYNTHETIC EXAMPLE III

Poly(t-butylstyrene-co-diisopropylaminoethylmethacrylate) with a composition of 72.86 t-butylstyrene and 27.14 diisopropylaminoethyl methacrylate was prepared by suspension polymerization as follows.

A 2.5 liter jacketed glass reactor was fitted with a stainless steel stirrer, thermal couple temperature probe, water cooled condenser with nitrogen outlet, a nitrogen inlet, internal/external cooling capabilities, and heated at 70° C. with a hot water circulating bath. The monomers were all passed through a column of basic aluminum oxide to remove inhibitors and purged with nitrogen gas to remove oxygen. The polymerization initiator 2,2'- azobis(2-methylpropionitrile), referred to as AIBN, was used as received.

To a suitable mixing vessel were added 89.16 grams of diisopropylaminoethyl methacrylate, 239.34 grams of t-butylstyrene, and 1.31 grams of AIBN. This mixture was then stirred to dissolve the AIBN until a clear organic phase was obtained. The organic phase was then transferred to a 3.0 liter vessel that contained 1.00 kilogram of a 2.5 percent by weight Air Products Airvol 603 polyvinyl alcohol, and 10.90 grams of potassium iodide aqueous phase inhibitor. The desired particle size was obtained by homogenizing the two phases with a Brinkman homogenizer equipped with a Polytron Generator with three stationary and three moving rings of flat rotor design. Homogenization was conducted for five minutes at about 8,000 RPM. The resulting suspended organic phase was then transferred to the preheated reactor and stirred at about 80 RPM to maintain stability of the suspension. The suspension was then maintained at 70° C. +/−1.0° C. for 5 hours and 46 minutes to complete polymerization. The polymer suspension was then cooled to about room temperature, about 25° C. throughout the Examples, unless otherwise indicated, removed from the reactor, washed and centrifuged 5 times with a 90/10 volume ratio of methanol/water and then a final washed with water only. The wet polymer suspension was then air dried, placed in a vacuum oven at from about 40.0° C. to 80.0° C. to complete drying, and further broken or attrited down to its primary particle size by ball milling followed by screening with a 65 $\mu$m sieve. The resulting suspension polymerized polymer had a volume median of about 5.0 $\mu$ (microns) and a second pass glass transition onset of 93.0° C. Molecular weight of the copolymer product by gel permeation chromatography was $M_w$=405,000, $M_n$=144,000, and MWD =2.8. Percent nitrogen by CHN analysis was 1.85 and 28 percent amine monomer content by NMR.

CARRIER EXAMPLE I

In the first step of the carrier coating process, 22.46 grams of the copolymer of Synthetic Example I, and more specifically, a copolymer of 60 weight percent styrene and 40 percent diisopropylaminoethyl methacrylate (DIAEMA) synthesized by an emulsion copolymerization, and 2,246 grams of a spherical steel core with a volume median diameter of 100 microns (Nuclear Metals, Inc.) were mixed. The mixing was accomplished in a V-Cone blender with the following process conditions: blender speed of 23.5 rotations per minute and a blend time of 30 minutes. There resulted uniformly distributed and electrostatically attached polymer on the core as determined by visual observation. In the second step, the resulting carrier particles were inserted into a rotating tube furnace for a period of 30 minutes. This furnace was maintained at a temperature of 400° F. thereby causing the polymer to melt and fuse to the core. The product from the kiln was screened through an 84 TBC (Tensile Bolt Cloth) mesh screen to remove any large agglomerates, specifically agglomerates larger than about 210, for example about 225 microns. The final product was comprised of a carrier core of spherical steel with a total of 1.0 percent coating weight polymer of poly(DIAEMA-co-styrene) (40 percent/60 percent monomer ratio) by weight on the surface, and the resulting carrier volume median diameter size was 100 microns.

A developer composition was then prepared by mixing 200 grams of the above prepared carrier with 10 grams of a 9 micron volume median diameter (volume average diameter) toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol A propylene oxide fumarate polymer, and about 10 percent by weight of REGAL 330®. Thereafter, the triboelectric charge on the carrier particles was determined by the known Faraday Cage process, and there was measured on the carrier a charge of 39.2 microcoulombs per gram. Further, the conductivity of the carrier as determined by forming a 0.1 inch long magnetic brush of the carrier particles, and measuring the conductivity by imposing a 10 volt potential across the brush was 2.75 $E^{11}$ mho-cm$^{-1}$. Therefore, these carrier particles were semiconductive.

CARRIER EXAMPLE II

In the first step of the carrier coating process, 22.46 grams of the copolymer of Synthetic Example II, and more specifically, a copolymer of 60 weight percent styrene and 40 percent diisopropylaminoethyl methacrylate (DIAEMA) synthesized by an emulsion copolymerization and containing divinyl benzene as a network or crosslink forming agent, and 2,246 grams of a spherical steel core with a particle size of 100 microns (Nuclear Metals, Inc.) were mixed. The mixing and fusing process steps were accomplished using the same conditions as carrier Example I. The final product was comprised of a carrier core of the spherical steel with a total of 1.0 percent coating weight polymer of poly (DIAEMA-co-styrene) (40 percent/60 percent monomer ratio) by weight on the surface. The resulting carrier volume median diameter size was 100 microns.

A developer composition was then prepared by the same process as carrier Example I. Thereafter, the triboelectric charge on the carrier particles was determined by the known Faraday Cage process, and there was measured on the carrier a charge of 44.1 microcoulombs per gram. Further, the conductivity of the carrier as determined by forming a 0.1 inch long magnetic brush of the carrier particles, and measuring the conductivity by imposing a 10 volt potential across the brush was 9.06 $E^{-15}$ mho-cm$^{-1}$. Therefore, these carrier particles were insulative.

CARRIER EXAMPLE III

In the first step of the carrier coating process, 22.7 grams of a copolymer of Synthetic Example III, and more specifically, a copolymer of about 73 weight percent t-butylstyrene and 27 percent diisopropylaminoethyl methacrylate (DIAEMA) and 2,270 grams of a spherical steel core with a volume median diameter of 100 microns (Nuclear Metals, Inc.) were mixed. The mixing and fusing process steps were accomplished using the same conditions as carrier Example I. The final product was comprised of a carrier core of spherical steel with a total of 1.0 percent coating weight polymer of poly(t-butylstyrene-co-diisopropylaminoethyl methacrylate) (73 percent/27 percent monomer ratio) by weight on the surface and a resulting carrier volume median diameter size of 100 microns.

A developer composition was then prepared by the same process as Example I. Thereafter, the triboelectric charge on the carrier particles was determined by the known Faraday Cage process, and there was measured on the carrier a charge of 33.9 microcoulombs per gram. Further, the conductivity of the carrier as determined by forming a 0.1 inch long magnetic brush of the carrier particles, and measuring the conductivity by imposing a 10 volt potential across the brush was 2.20 $E^{15}$ mho-cm$^{-1}$. Therefore, these carrier particles were insulative.

CARRIER EXAMPLE IV

In the first step of the carrier coating process, 44.91 grams of a copolymer of poly(t-butylstyrene-co-diisopropylaminoethyl methacrylate) in a 60/40 weight percent monomer ratio with a particle size of about 5.4 microns were mixed with 4,491.09 grams of a spherical steel core with a volume median diameter of 100 microns (Nuclear Metals, Inc.). The mixing and the remainder of the carrier coating process were accomplished in the same manner as carrier Example III. The final product was comprised of a spherical steel carrier core with a total of 1.0 percent by weight copolymer composed of poly(t-butylstyrene-co-diisopropylaminoethyl methacrylate) in a 60/40 weight percent monomer ratio on the surface of the carrier and the resulting carrier volume median diameter size was 100 microns.

A developer composition was then prepared by the process of Carrier Example I. Thereafter, the triboelectric charge on the carrier particles was determined by the known Faraday Cage process, and it was believed that a high triboelectric value would be obtained, based on the measured difference between the triboelectric values of the carrier in Carrier Example III and the known low triboelectric value, i.e., near zero, of a styrene coated carrier, in conjunction with an increase in dimethylaminoethyl methacrylate concentration. Specifically, it was believed that a triboelectric value of between 60 and 80 microcoulombs per gram would be obtained. Further, it was believed that the conductivity of the carrier, as determined by forming a 0.1 inch long magnetic brush of the carrier particles, and measuring the conductivity by imposing a 10 volt potential across the brush, would be too insulating to be measured ($>10^{-15}$ mho-cm-$^{-1}$). Therefore, these carrier particles were insulative. Additional adjustments to the dimethylaminoethyl methacrylate concentration, specifically to values intermediate to the 27 percent concentration of Carrier Example III and the 40 percent concentration of the current Example, were believed to yield triboelectric values of any magnitude between 33 and 80 microcoulombs per gram.

Other modifications of the present invention may occur to those of ordinary skill in the art subsequent to a review of the present application, and these modifications, including equivalents thereof, are intended to be included within the scope of the present invention.

What is claimed is:

1. A carrier comprised of a core and a first polymer coating comprising a first polymer of (1) styrene/ monoalkylaminoalkyl methacrylate or (2) styrene/dialkylaminoalkyl methacrylate, and a second polymer coating of a polyurethane.

2. A carrier in accordance with claim 1 wherein each of said alkyls contain from 1 to about 25 carbon atoms.

3. A carrier in accordance with claim 2 wherein said dialkylaminoalkyl methacrylate is diisopropylaminoethyl methacrylate.

4. A carrier in accordance with claim 2 with a volume average diameter of from about 50 to about 200 microns.

5. A carrier in accordance with claim 1 wherein each of said alkyls contain from 1 to about 6 carbon atoms.

6. A carrier in accordance with claim 1 wherein said first polymer is a copolymer of styrene and dimethylaminoethyl methacrylate, a copolymer of styrene and diethylaminoethyl methacrylate, a copolymer of styrene and t-butylaminoethyl methacrylate, or a copolymer of styrene and diisopropylaminoethyl methacrylate.

7. A carrier in accordance with claim 1 wherein the first polymer is a copolymer of t-butyl styrene and dimethylaminoethyl methacrylate, a copolymer of t-butyl styrene and diethylaminoethyl methacrylate, a copolymer of t-butyl styrene and t-butylaminoethyl methacrylate, or a copolymer of t-butyl styrene and diisopropylaminoethyl methacrylate.

8. A carrier in accordance with claim 1 wherein said first polymer is selected from the group consisting of polystyrene/monoalkyl or dialkylaminoalkyl methacrylate, and poly t-butyl styrene/monoalkyl or poly t-butyl dialkylaminoalkyl methacrylate.

9. A carrier in accordance with claim 6 wherein the first polymer contains from about 50 to about 95 weight percent of styrene, and from about 5 to about 50 weight percent of said monoalkyl or dialkylaminoalkyl methacrylate.

10. A carrier in accordance with claim 1 wherein first polymer (1) possesses an $M_w$ of from about 20,000 to about 800,000, and an $M_n$ of from about 12,000 to about 350,000, and polymer (2) possesses an $M_w$ of from about 20,000 to about 800,000, and of an $M_n$ of from about 12,000 to about 350,000 as measured by gel permeation chromatography.

11. A carrier in accordance with claim 1 wherein the first polymer coating weight is from about 0.1 to about 20 weight percent.

12. A carrier in accordance with claim 1 wherein the first polymer coating weight is from about 1 to about 3 weight percent.

13. A carrier in accordance with claim 1 wherein the first polymer coating contains a conductive component.

14. A carrier in accordance with claim 13 wherein the conductive component is a metal oxide, or is carbon black.

15. A carrier in accordance with claim 13 wherein said conductive component is carbon black selected in an amount of from about 10 to about 60 weight percent.

16. A carrier in accordance with claim 1 wherein said core is a metal, a metal oxide, or a ferrite.

17. A carrier in accordance with claim 1 with a triboelectric charge of from about a positive 30 to about a positive 80 microcoulombs per gram.

18. A carrier in accordance with claim 1 with a triboelectric charge of from about a positive 35 to about a positive 50 microcoulombs per gram.

19. A carrier in accordance with claim 1 wherein said core is a metal of spherical or atomized steel, a metal oxide magnetite, Cu/Zn-ferrite, Ni/Zn-ferrite, Sr (strontium)-ferrite, or Ba-ferrite.

20. A carrier in accordance with claim 1 wherein said alkyl contains from 1 to about 12 carbon atoms.

21. A developer comprised of (1) a carrier core having a first coating of a polymer of styrene/monoalkylamino methacrylate or styrene/dialkylaminoalkyl methacrylate, and a second coating of a polyurethane, and (2) a toner.

22. A developer in accordance with claim 21 wherein the carrier core is selected from the group consisting of iron, ferrites, steel and nickel.

23. A carrier in accordance with claim 20 with a carrier triboelectric charge of from about a positive 30 to about a positive 80 microcoulombs per gram, and a toner triboelectric charge of from about a negative 30 to about a negative 80 microcoulombs per gram.

24. An electrostatographic imaging process wherein an image is developed with the developer composition of claim 21.

25. A carrier comprised of a core and a first coating of a polymer of styrene/alkylaminoalkyl methacrylate, styrene/dialkylaminoalkyl methacrylate, or mixtures thereof, and a second polymer coating of a polyurethane.

26. A carrier comprised of a core and a polymer coating of a copolymer of t-butyl styrene and dimethylaminoethyl methacrylate, a copolymer of t-butyl styrene and diethylaminoethyl methacrylate, a copolymer of t-butyl styrene and t-butylaminoethyl methacrylate, or a copolymer of t-butyl styrene and diisopropylaminoethyl methacrylate.

27. A carrier in accordance with claim 26 wherein said polymer contains dispersed therein conductive components.

28. A carrier in accordance with claim 27 wherein said conductive components are comprised of carbon black.

29. A carrier in accordance with claim 26 wherein said carrier includes a second polymer coating.

30. A carrier in accordance with claim 26 wherein said second polymer coating comprises polyurethane.

31. A developer comprised of the carrier of claim 26 and a toner.

32. A carrier in accordance with claim 1 wherein said first polymer coating is poly(styrene/diisopropylaminoethyl methacrylate) with a diisopropylaminoethyl methacrylate content of from about 27 weight percent to about 40 weight percent, the coating weight of polymer on said core is from about 0.3 to about 1.0 percent, the carrier volume median diameter is from about 65 to about 120 microns, and the core is steel or a ferrite.

* * * * *